US009162463B2

(12) United States Patent
Ito

(10) Patent No.: US 9,162,463 B2
(45) Date of Patent: Oct. 20, 2015

(54) LIQUID JETTING APPARATUS AND METHOD FOR CLEANING WIPER

(71) Applicant: Brother Kogyo Kabushiki Kaisha, Nagoya-shi, Aichi-Ken (JP)

(72) Inventor: Takashi Ito, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 14/282,024

(22) Filed: May 20, 2014

(65) Prior Publication Data

US 2014/0340447 A1 Nov. 20, 2014

(30) Foreign Application Priority Data

May 20, 2013 (JP) ..... 2013-106187

(51) Int. Cl.
*B41J 2/165* (2006.01)

(52) U.S. Cl.
CPC ..... *B41J 2/16535* (2013.01); *B41J 2/16526* (2013.01); *B41J 2/16541* (2013.01); *B41J 2/16552* (2013.01)

(58) Field of Classification Search
None
See application file for complete search history.

(56) References Cited

U.S. PATENT DOCUMENTS

| | | | | |
|---|---|---|---|---|
| 6,340,219 | B1 | 1/2002 | Kumagai et al. | |
| 2006/0170727 | A1 * | 8/2006 | Imazeki et al. | 347/33 |
| 2007/0188545 | A1 * | 8/2007 | Miyamoto | 347/33 |
| 2009/0267987 | A1 * | 10/2009 | Kachi et al. | 347/33 |

FOREIGN PATENT DOCUMENTS

| | | |
|---|---|---|
| JP | 2007-168355 | 7/2007 |
| JP | 4277156 | 3/2009 |
| JP | 2014-240129 | 12/2014 |

* cited by examiner

*Primary Examiner* — Alejandro Valencia
(74) *Attorney, Agent, or Firm* — Frommer Lawrence & Haug LLP

(57) ABSTRACT

There is provided a liquid jetting apparatus including: a liquid jetting head including a liquid jetting surface; a wiper including first and second wiping portions; a moving mechanism; a liquid discharge mechanism; and a controller configured to perform: controlling the moving mechanism to cause the first wiping portion to wipe the liquid jetting surface in a state that the first wiping portion is brought into contact with the liquid jetting surface; controlling the moving mechanism to cause the second wiping portion to wipe the liquid jetting surface in a state that the second wiping portion is brought into contact with the liquid jetting surface; and controlling the liquid jetting head to jet the liquid from the nozzles such that the liquid makes a contact with the second wiping portion to clean the second wiping portion.

11 Claims, 12 Drawing Sheets

(AT THE TIME OF PRINTING)

(AT THE TIME OF DISCHARGING INK)

(AT THE TIME OF WIPING)

(INK ADHESION PROCESS)

(CLEANING PROCESS)

(WIPE-OFF PROCESS)

(WETTING PROCESS)

(CLEANING PROCESS)

(CLEANING PROCESS)

LIQUID JETTING APPARATUS AND METHOD FOR CLEANING WIPER

CROSS REFERENCE TO RELATED APPLICATION

The present application claims priority from Japanese Patent Application No. 2013-406187, filed on May 20, 2013, the disclosure of which is incorporated herein by reference in its entirety.

BACKGROUND OF THE INVENTION

1. Field of the Invention:

The present invention relates to a liquid jetting apparatus and a method for cleaning a wiper.

2. Description of the Related Art:

As an example of liquid jetting apparatuses which discharge liquids, there is known such a liquid jetting apparatus including a mechanism which removes foreign substances and the like adhering to a liquid jetting surface formed with nozzles. For example, there is known a wiping unit which wipes an ink jetting surface (nozzle forming surface) of an inkjet head and is capable of both removal operations of removing the ink adhering to the ink jetting surface and removing the foreign substances adhering to the ink jetting surface.

The above wiping unit has a wiper pressed against the ink jetting surface, The wiper is made from a composite material which joins a wiping material formed of an elastic plate such as rubber on one side, and a rubbing material such as felt on the other side. The wiper moves in one direction relative to the ink jetting surface to wipe away the ink adhering to the ink jetting surface with the wiping material. Further, the wiper moves in the direction opposite to the one direction relative to the ink jetting surface to rub away the foreign substances adhering to the ink jetting surface with the rubbing material.

SUMMARY OF THE INVENTION

If the above wiping unit is left in a state that the foreign substances removed from the ink jetting surface are adherent to the rubbing material of the wiper, there is fear that the foreign substances might come into contact with the ink jetting surface to damage the ink jetting surface at a subsequent wiping. Further, it is possible that the removed foreign substances might adhere to the ink jetting surface again.

An object of the present teaching is to reliably remove foreign substances, which have been wiped away from a liquid jetting surface by a wiper, from the wiper.

According to a first aspect of the present teaching, there is provided a liquid jetting apparatus configured to jet liquid, including:

a liquid jetting head including a liquid jetting surface in which a plurality of nozzles are formed;

a wiper configured to wipe the liquid jetting surface of the liquid jetting head and including a first wiping portion which is configured to wipe away liquid adhering to the liquid jetting surface and a second wiping portion which is configured to eliminate a foreign substance adhering to the liquid jetting surface;

a moving mechanism configured to move at least one of the wiper and the liquid jetting head such that the wiper is moved relative to the liquid jetting head in a direction parallel to the liquid jetting surface;

a liquid discharge mechanism configured to discharge the liquid from the nozzles of the liquid jetting head; and a controller configured to control the liquid, jetting head, the moving mechanism, and the liquid discharge mechanism, the controller being configured to perform:

controlling the moving mechanism to cause the first wiping portion to wipe the liquid jetting surface in a state that the first wiping portion is brought into contact with the liquid jetting surface;

controlling the moving mechanism to cause the second wiping portion to wipe the liquid jetting surface in a state that the second wiping portion is brought into contact with the liquid jetting surface; and controlling the liquid jetting head to jet the liquid from the nozzles such that the liquid makes a contact with the second wiping portion to clean the second wiping portion, The controller may be configured to perform: controlling the liquid discharge mechanism to discharge the liquid from the nozzles so as to let the liquid adhere to the liquid jetting surface; and controlling the moving mechanism to clean the second wiping portion by making the wiper contact with the liquid adhering to the liquid jetting surface and letting said liquid flow from the liquid jetting surface to the second wiping portion.

In the present teaching, the second wiping portion for removing the foreign substances is cleaned before or after the liquid jetting surface is wiped by the second wiping portion. Therefore, a subsequent wiping can be carried out by the second wiping portion from which the foreign substances have been eliminated. Since no foreign substances remain in the second wiping portion, the ink jetting surface suffers no damage due to the foreign substances, and no foreign substances adhere to the ink jetting surface again. The second wiping portion is cleaned as follows. That is, the liquid is allowed to adhere to the liquid jetting surface by being discharged from the nozzles by the liquid discharge mechanism, and the liquid adhering to the liquid jetting surface is allowed to flow to the second wiping portion by being brought into contact with the wiper. As described above, since the wiper is cleaned by using the liquid discharged from the nozzles, any special cleaning liquid and/or cleaning device is/are unnecessary.

In the present teaching, the "liquid discharge mechanism" includes not only the mechanism and/or device for jetting the liquid from the nozzles of the liquid jetting head, but also the mechanism, device, etc., which is/are provided separately from the mechanism for jetting the liquid and the like and forcibly discharge(s) the liquid from the nozzles of the liquid jetting head. That is, the operation "the liquid is discharged from the nozzles by the liquid discharge mechanism" includes both an operation in which the liquid is discharged by jetting liquid droplets from the nozzles using the mechanism and/or the device for jetting the liquid from the nozzles of the liquid jetting head, and an operation in which the liquid is discharged by jetting liquid droplets from the nozzles using the mechanism and/or the device provided separately from the mechanism for jetting the liquid and the like and forcibly discharging the liquid from the nozzles of the liquid jetting head.

In the present teaching, the controller may be configured to perform controlling the liquid jetting head and the moving mechanism to jet the liquid from the nozzles to the wiper, and thereby cleaning the second wiping portion. In this case, it is possible to blow away and remove the foreign substances adhering to the second wiping portion by energy of the liquid jetted from the nozzles, in addition to the function of rinsing the foreign substances with the liquid adhering to the wiper. Therefore, the cleaning effect becomes great.

According to a second aspect of the present teaching, there is provided a method for cleaning a wiper of a liquid jetting apparatus, the liquid jetting apparatus including:

a liquid jetting head including a liquid jetting surface in which a plurality of nozzles are formed;

the wiper including a first wiping portion configured to wipe away liquid adhering to the liquid jetting surface and a second wiping portion configured to eliminate a foreign substance adhering to the liquid jetting surface; and a liquid discharge mechanism configured to discharge the liquid from the nozzles of the liquid jetting head, the method including:

discharging the liquid from the nozzles by the liquid discharge mechanism to allow the liquid to adhere to the liquid jetting surface; and cleaning the second wiping portion by making the wiper contact with the liquid adhering to the liquid jetting surface and letting the liquid flow from the liquid jetting surface to the second wiping portion.

In the present teaching, by cleaning the second wiping portion for eliminating the foreign substances, it is possible to perform a subsequent wiping by the second wiping portion from which the foreign substances have been eliminated. The second wiping portion is cleaned as follows. That is, the liquid is allowed to adhere to the liquid jetting surface by being discharged from the nozzles by the liquid discharge mechanism, and the liquid adhering to the liquid jetting surface is allowed to flow by being brought into contact with the second wiping portion. Accordingly, since the wiper is cleaned by using the liquid discharged from the nozzles, any special cleaning liquid and/or cleaning device is/are unnecessary.

DESCRIPTION OF THE EMBODIMENTS

Next, an embodiment of the present teaching will he explained. This embodiment is one example in which the present teaching is applied to an ink-jet printer which jets ink to a sheet of recording paper transported in a predetermined transport direction to record an image and the like, in the following description, terms concerning directions are defined as follows. The upper side and lower side in FIG. 1 are respectively defined as the front side and rear side of a printer 1; the left side and right side in FIG. 1 are respectively defined as the left side and right side of the printer 1; and the near side and back or far side in FIG. 1 in a direction perpendicular to the sheet surface of FIG. 1 are respectively defined as the upper side and lower side of the printer 1.

[Schematic Structure of Printer]

Figure 1:
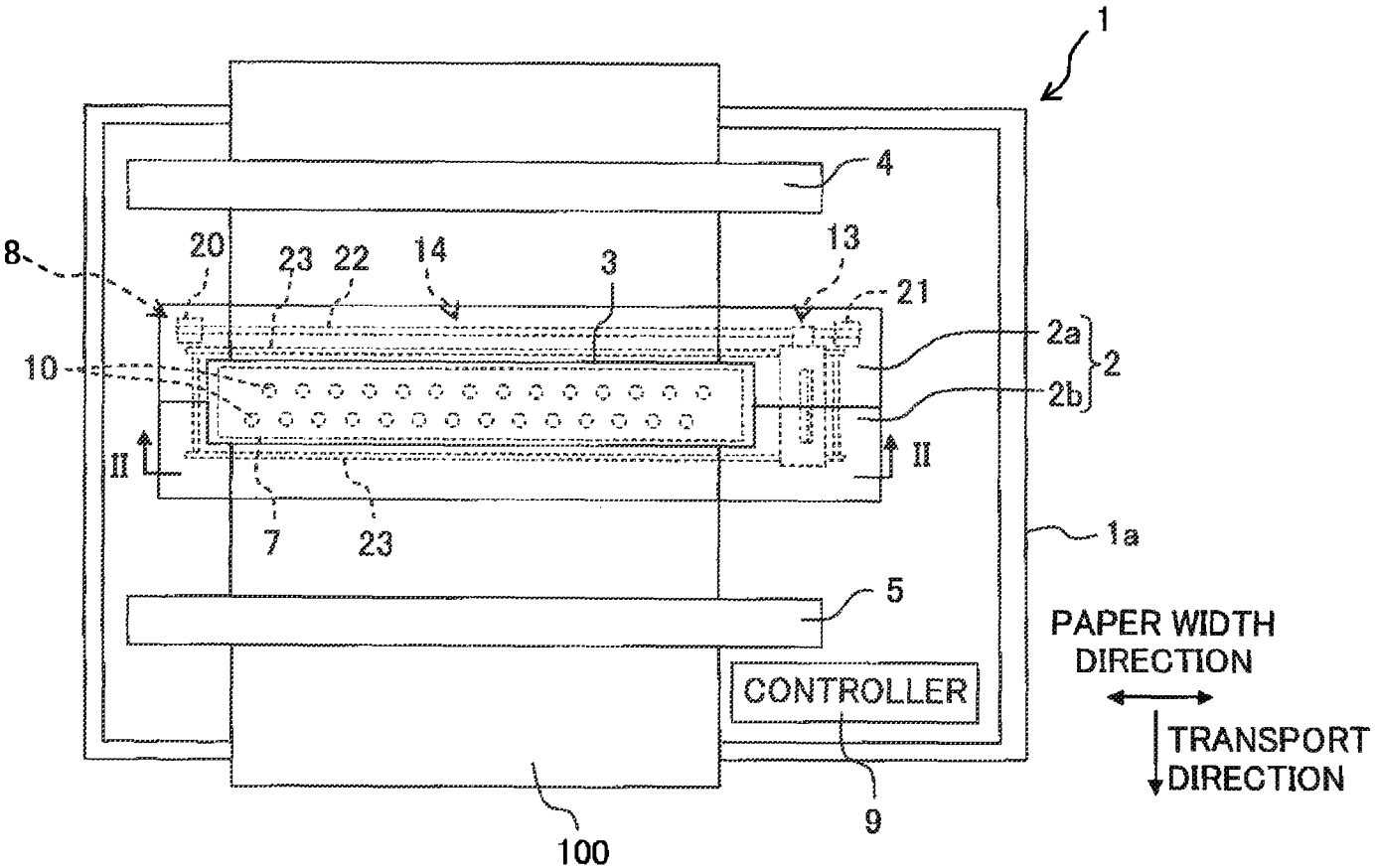
FIG. 1 is a schematic plan view of a printer according to an embodiment of the present teaching.
Figure 2:
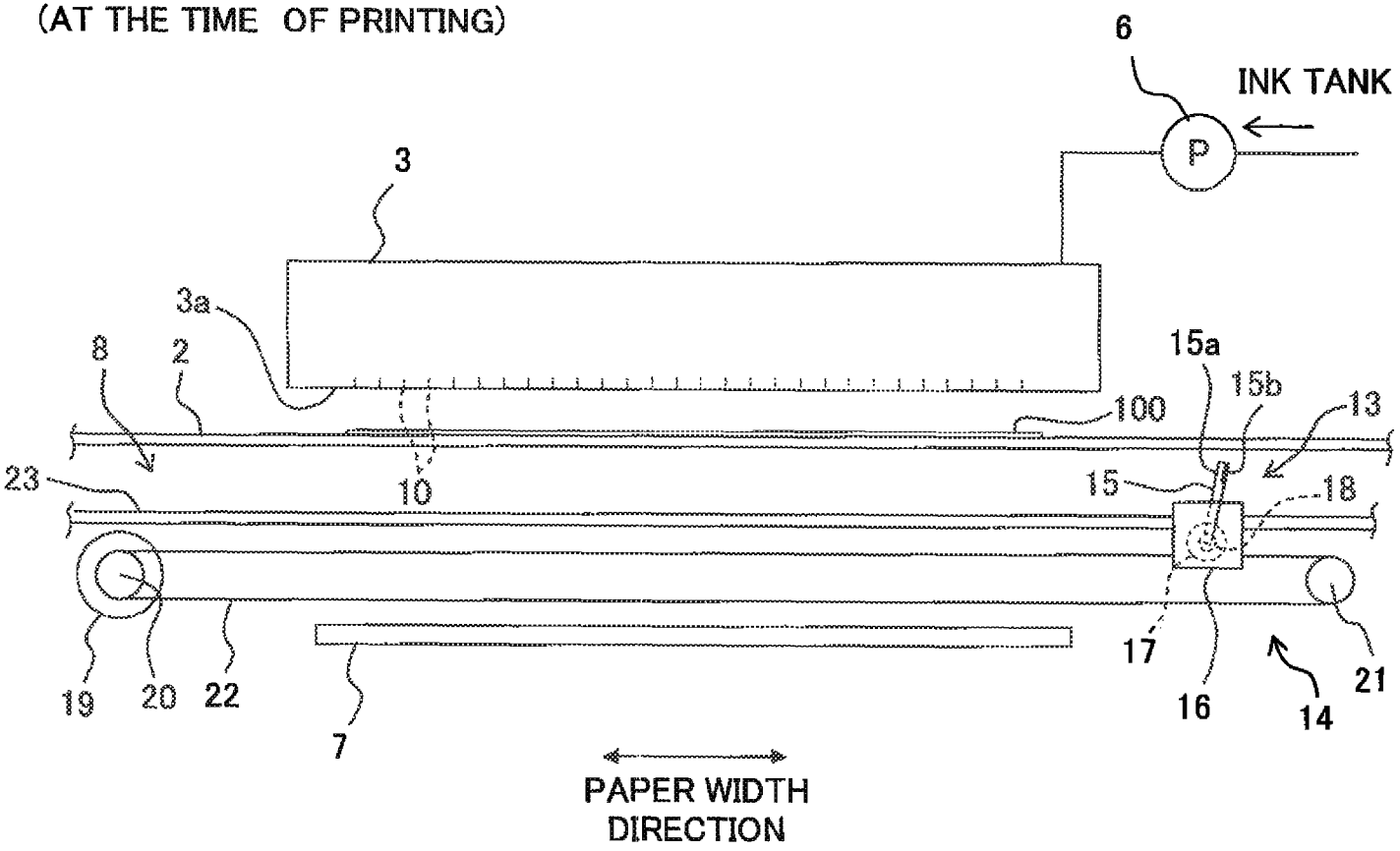
FIG. 2 is a view taken along the arrow of FIG. 1.
Figure 3:
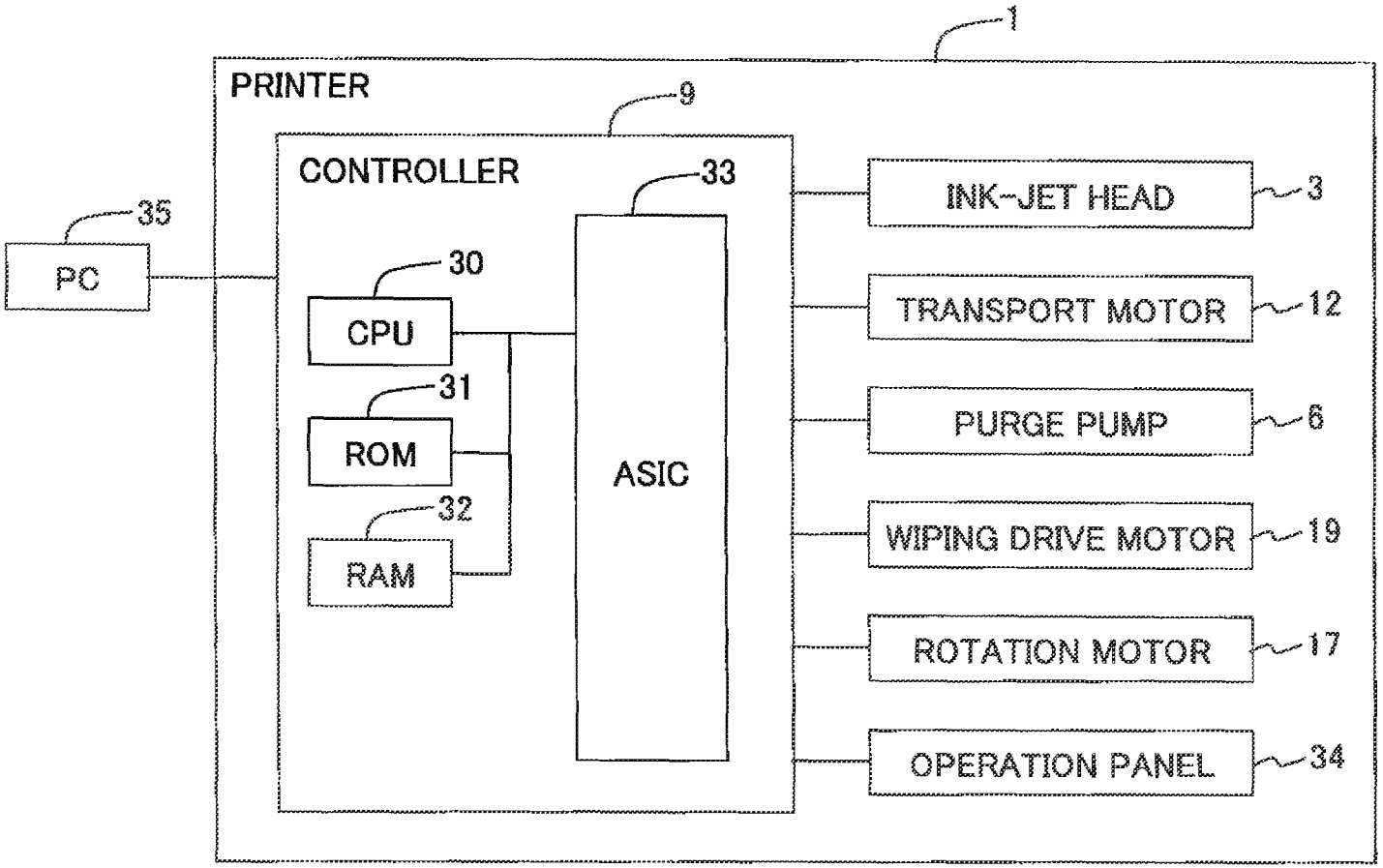
FIG. 3 is a block diagram schematically showing an electric configuration of the printer.

As shown in FIGS. 1 to 3, the printer 1 includes a platen 2, an ink-jet head 3, two transport rollers 4. 5, a purge pump 6, an ink receiving member 7, a wiping unit 8, a controller 9, and the like.

The platen 2 includes two plate members 2*a* and 2*b* arranged in the front-rear direction. The two plate members 2*a* and 2*b* are configured to be capable of taking a horizontal posture and an opened posture in which the two plate members 2*a* and 2*b* are allowed to pivot from the horizontal posture to open downward like a double-leaf door, by being driven with an unillustrated opening-closing mechanism. As shown in FIGS. 1 and 2, when the two plate members 2*a* and 2*b* are in the horizontal posture, a sheet of recording paper 100 is placed on the upper surface of the two plate members 2*a* and 2*b*. The wiping unit 8 and the ink receiving member 7 are accommodated in a space below the platen 2.

The ink-jet head 3 (liquid jetting head of the present teaching) is a line-type head elongated in a paper width direction. The inkjet head 3 is connected to an unillustrated ink tank to be supplied with the ink from the ink tank. Two nozzle rows are formed, in the lower surface of the ink-jet head 3, to align in a direction (transport direction) perpendicular to a longitudinal direction of the ink-jet head 3 (paper width direction), and a plurality of nozzles 10 are arranged in each of the nozzle rows to extend in the longitudinal direction. Hereinbelow, the lower surface of the inkjet head 3 on which the nozzles 10 are formed will be referred to as an ink jetting surface 3*a* (liquid jetting surface of the present teaching). The ink-jet head 3 is able to move up and down relative to the platen 2 by being driven by an illustrated head lifting mechanism.

The two transport rollers 4, 5 are arranged to sandwich the ink-jet head 3 in the transport direction orthogonal to the longitudinal direction of the ink-jet head 3. The two transport rollers 4, 5 are driven to rotate synchronously by a transport motor 12 (see FIG. 3) to transport the recording paper 100 in the transport direction.

The ink-jet head 3 prints desired characters, images, and the like on the recording paper 100 by jetting the ink from each of the nozzles 10 of the ink jetting surface 3*a* onto the recording paper 100 transported in the transport direction by the two transport rollers 4, 5.

As shown in FIG. 2, the purge pump 6 (liquid discharge mechanism of the present teaching) is arranged between the ink-jet head 3 and the unillustrated ink tank. The purge pump 6 is used to forcibly push and discharge the ink from the nozzles 10 of the ink-jet head 3 by pressurizing the ink from the ink tank and supplying the same to the ink-jet head 3. In this situation, because the foreign substances and air mixed into the ink-jet head 3 are discharged from the nozzles, as well as the dried and thickened ink, etc., it is possible to eliminate any jetting failure of the nozzles 10, or to prevent any jetting failure from occurring. As it will be described later, the operation for jetting the ink from each of the nozzles 10 by the purge pump 6 may be sometimes performed for a purpose different from the elimination of the jetting failure and the like. For example, the ink may be sometimes jetted from the nozzles to prevent the nozzles from drying. In the following description, the operation for discharging the ink, for example, to eliminate the jetting failure of the nozzles 10 will be referred to as "purge", and the operation for jetting the ink from the nozzles, for example, to prevent the nozzles from drying will be referred to as "flushing".

The ink receiving member 7 is a member for receiving a waste ink discharged from the ink-jet head 3 through the purge, the flushing, or the like. The ink receiving member 7 is a member in the form of a plate made of glass, for example. The ink receiving member 7 is movable up and down by being driven with an unillustrated ink-receiving lifting mechanism.

Figure 4:
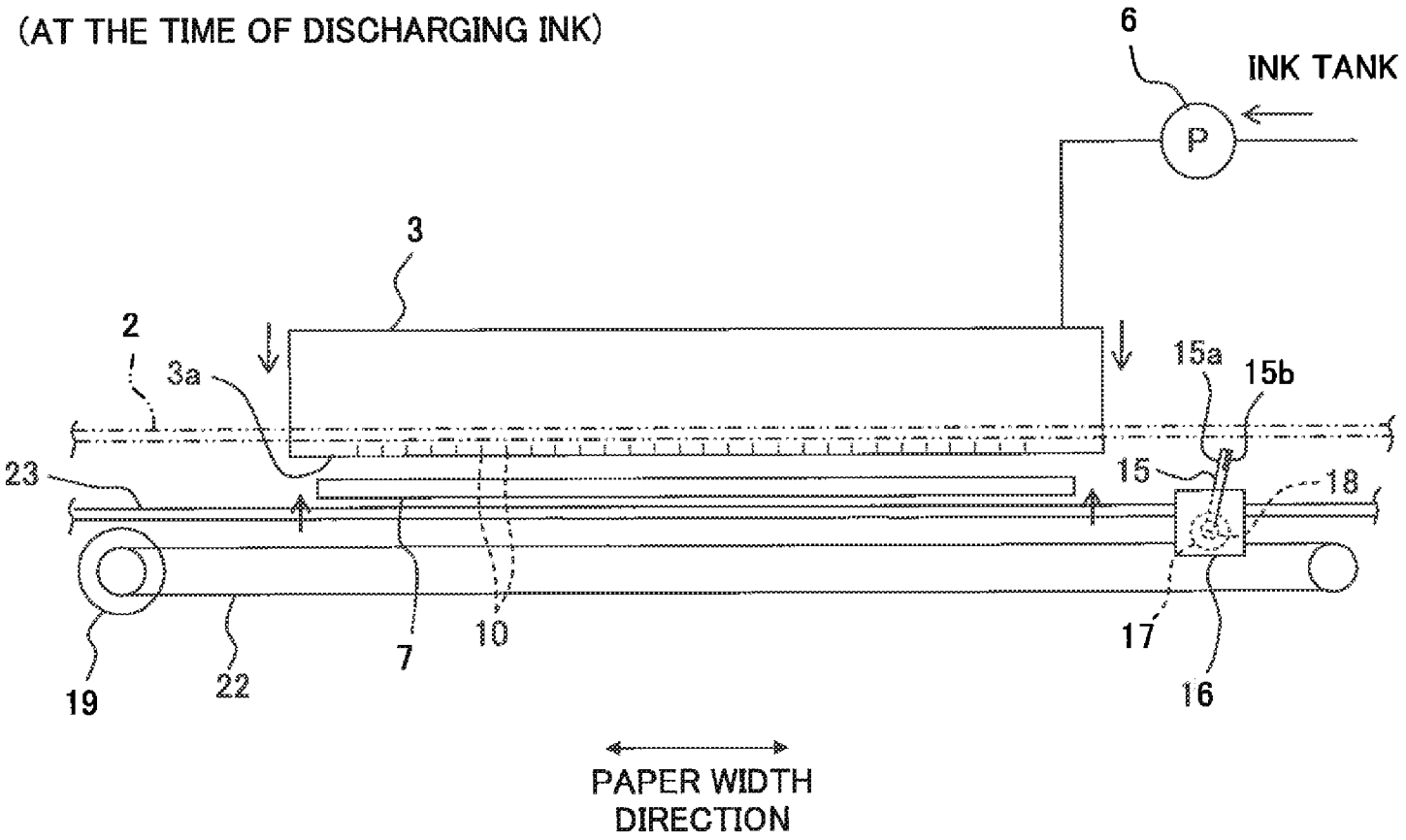
FIG. 4 shows the printer at the time of discharging ink from an ink-jet head.

In FIG. 2, the two plate members 2*a* and 2*h* are in the horizontal posture, and the ink receiving member 7 stands by in the space below the platen 2 at a position further below the wiping unit 8. When the purge, the flushing, or the like is performed, the two plate members 2*a* and 2*h* of the platen 2 are allowed to pivot so as to open as a double door, and thereby the ink, receiving member 7 is exposed. Subsequently, the ink receiving member 7 is driven upward by the unillustrated ink-receiving lifting mechanism to move from the position shown in FIG. 2 to the position shown in FIG. 4 located above the two plate members 2*a* and 2*b*. In this situation, as shown in FIG. 4, the ink-jet head 3 is lowered down by being driven downward with the unillustrated head lifting mechanism. Accordingly, the ink receiving member 7 is positioned immediately below the ink jetting surface 3*a* of the ink-jet head 3. The purge or flushing is performed in this state, and the ink discharged from the nozzles 10 of the ink-jet head 3 is recovered by the ink receiving member 7.

As shown in FIGS. 1 and 2, the wiping unit 8 includes a wiping device 13 and a wiping drive mechanism 14 moving the wiping device 13 in the paper width direction parallel to the ink jetting surface 3*a*. As shown in FIG. 2, the wiping unit 8 is arranged below the platen 2. Unlike the ink-jet head 3 and the ink receiving member 7, the wiping unit 8 is provided fixedly to a casing 1*a* of the printer (see FIG. 1) and thus never moves up and down.

The wiping device 13 wipes the ink jetting surface 3*a* of the ink-jet head 3 while moving in the paper width direction to remove the ink and the foreign substances adhering to the ink jetting surface 3*a*. The discharge of the ink from the nozzles 10 by the purge pump 6 causes a part of the ink discharged from the nozzles 10 to adhere to the ink jetting surface 3*a*, In order to remove the ink adhering to the ink jetting surface 3*a*, the ink jetting surface 3*a* is wiped by the wiping device 13, Further, the adhesion of the foreign substances to parts or components in the vicinity of the nozzles 10 causes the jetting failure of the nozzles 10. The foreign substances adhering to the ink jetting surface 3*a* include paper powder or paper dust (paper fiber) stuck in the nozzles 10 of the ink jetting surface 3*a*, solidified ink clinging to the ink jetting surface 3*a*, etc. By letting the wiping unit 13 wipe the ink jetting surface 3*a*, such foreign substances as mentioned above are removed from the ink jetting surface 3*a*.

Figure 5:
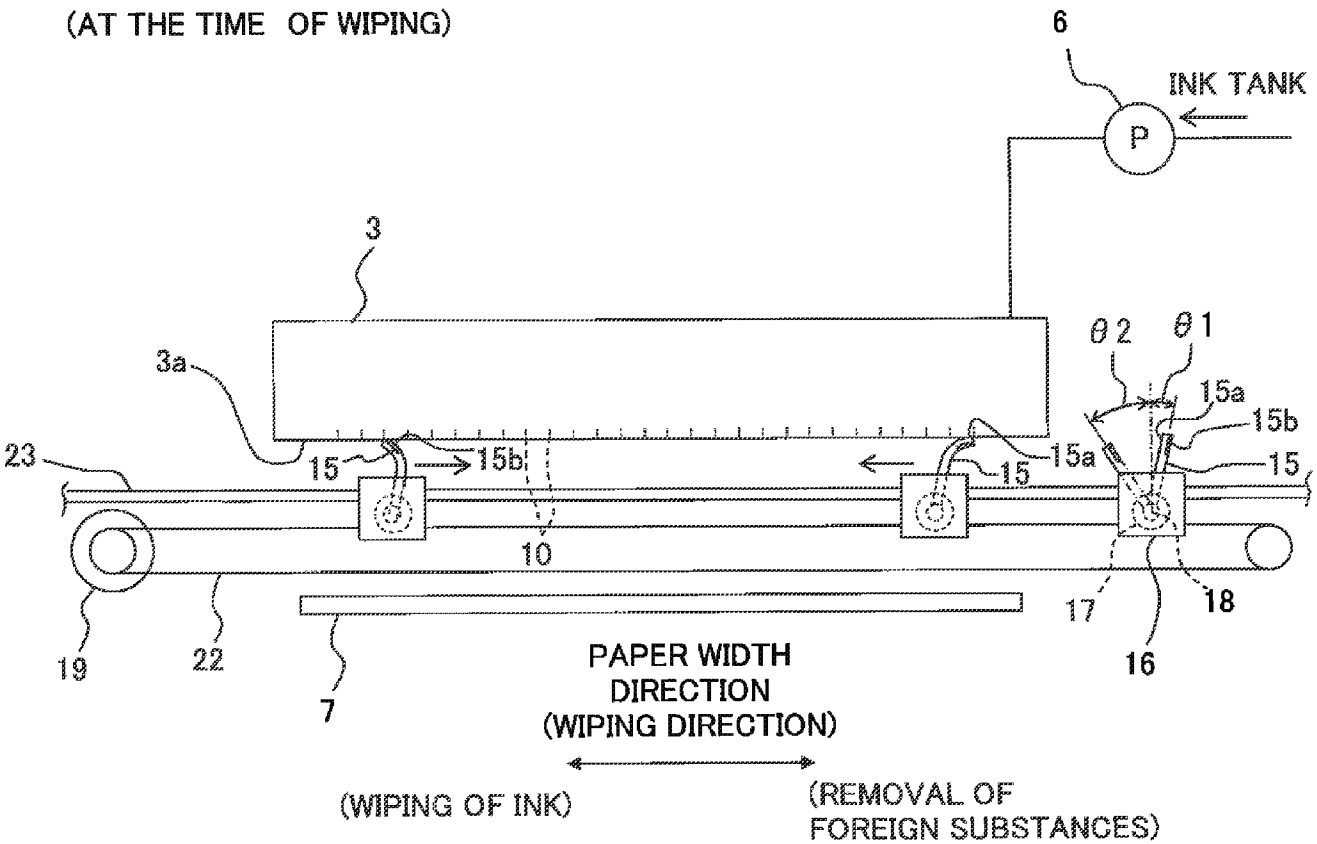
FIG. 5 is a view illustrating wiping of an ink jetting surface by a wiping device.

As shown in FIG. 4, in a case that the ink jetting surface 3*a* is wiped by the wiping device 13 after the ink is discharged by the purge pump 6, the ink-receiving member 7 is driven downward by the unillustrated ink-receiving lifting mechanism so as to return to the position below the wiping unit 8, as shown in FIG. 5.

The wiping device 13 includes a wiper 15, a holding member 16 holding the wiper 15, and a rotation motor 17 rotating the wiper 15.

The wiper 15 is a plate-like member formed of an elastic material such as rubber. Those provided for the wiper 15 at the front end portion include a first wiping portion 15*a* wiping away the ink adhering to the ink jetting surface 3*a* and a second wiping portion 15*b* wiping away the foreign substances, such as paper dust, adhering to the ink jetting surface 3*a*. The first wiping portion 15*a* is provided at the left side portion of the front end portion of the wiper 15. The second wiping portion 15*b* is provided at the right side portion of the front end portion of the wiper 15.

The second wiping portion 15*b* has a surface roughness greater than that of the first wiping portion 15*a*. The wiping with the first wiping portion 15*a* haying small surface roughness can prevent the ink adhering to the ink jetting surface 3*a* from being left thereon. The wiping with the second wiping portion 15*b* having great surface roughness can remove or wipe away the foreign substances clinging to the ink jetting surface 3*a* with a strong force in a scrape-off manner.

In order that the first wiping portion 15*a*. and the second wiping portion 15*b* are different from each other in surface roughness, the following method can be adopted. For example, in a case that the wiper 15 is molded via mold injection, a change is applied beforehand to the inside roughness of the metallic mold in the places for molding the first wiping portion 15*a* or the second wiping portion 15*b*. Alternatively, it is also possible to form the first wiping portion 15*a* or the second wiping portion 15*b* by a publicly-known rough surface treatment or minor-like finishing such as laser processing and polishing processing. Or, the first wiping portion 15*a* or the second wiping portion 15*b* may he formed by applying, to the front end portion of the wiper 15, a sheet or the like formed of a material having surface roughness different from that of said front end portion.

As shown in FIG. 5, the wiper 15 is attached to the holding member 16 via a rotational shaft 18. The rotational shaft 18 extends in the transport direction (direction perpendicular to the sheet surface of FIG. 5) orthogonal to the paper width direction, which is parallel to the ink jetting surface 3*a* and is a moving direction of the wiping device 13, The rotation motor 17 connected to the rotational shaft 18 is accommodated in the holding member 16, The rotation or pivot of the wiper 15 by the rotation motor 17 in a vertical surface parallel to the paper width direction can switch a posture of the wiper 15 between a first posture (depicted by a solid line) that the wiper 15 is inclined to the right side in the vertical direction by an angle θ1 and a second posture (depicted by two-dot lines) that the wiper 15 is inclined to the left side in the vertical direction by an angle θ2 (>θ1), Accordingly, it is possible to change the up-down position of each of the first and second wiping portions 15*a*, 15*b* relative to the ink jetting surface 3*a*. (position in a direction perpendicular to the ink jetting surface 3*a*). That is, the position of each of the first and second wiping portions 15*a*, 15*b* in the first posture of the wiper 15 is higher than the position of each of the first and second wiping portions 15*a*, 15*b* in the second posture. The rotation motor 17 corresponds to a position change mechanism of the present teaching.

As shown in FIGS. 1, 2, 5, etc., the wiping drive mechanism 14 includes a wiping drive motor 19 (moving mechanism of the present teaching), a belt 22 connected to the wiping drive motor 19 via pulleys 20, 21, and two guide rails 23 extending in the paper width direction. The belt 22 is connected to the holding member 16. As shown in FIG. 1, the two guide rails 23 are arranged in both of the front and rear sides of the holding member 16, respectively so that the front end portion and the rear end portion of the holding member 16 are slidably attached to the respective two guide rails 23. The wiping drive motor 19 drives the belt 22 to run, which allows the wiping device 13 to move in the paper width direction by being guided by the two guide rails 23. Further, by switching the rotary direction of the wiping drive motor 19, it is possible to move the wiping device 13 in two directions, i.e., the leftward direction and the rightward direction. In a case that the wiping device 13 moves in the leftward direction, the ink jetting surface 3*a* is wiped by the first wiping section 15*a*. In a case that the wiping device 13 moves in the rightward direction, the ink jetting surface 3*a* is wiped by the second wiping section 15*b*.

The configuration of moving the wiping device 13 is not limited to the configuration of FIG. 2. For example, it is also configurable to move the wiping device 13 in the paper width direction by coupling the holding member 16 with screw shaft extending in the paper width direction in a. screw-coupling manner, and then causing the wiping drive motor 19 to drive and rotate the screw shaft.

As shown in FIGS. 1 and 2, the wiping device 13 stands by in a position on the right side of the ink-jet head 3 when it does not carry out the wiping of the ink jetting surface 3*a*. On the other hand, when the wiping of the ink jetting surface 3*a* is performed, as shown in FIG. 5, the wiping device 13 is driven by the wiping drive mechanism 14 to move in the paper width direction, with the two plate members 2*a* and 2*b* of the platen 2 open. Thus, the wiping device 13 moves relative to the ink jetting surface 3*a* in a state that the front end portion of the wiper 15 is brought into contact with the ink jetting surface 3*a* to wipe away the foreign substances and ink adhering to the ink jetting surface 3*a*. The wiping of the ink jetting surface 3*a* by the wiping device 13 will be explained in detail.

As shown in FIG. 3, the controller 9 includes a. Central Processing Unit (CPU) 30, a Read Only Memory (ROM) 31, a Random Access Memory (RAM) 32, and an Application Specific Integrated Circuit (ASIC) 33 including various control circuits, etc. The controller 9 is connected to the ink jet head 3, the transport motor 12, the purge pump 6, the wiping drive motor 19, the rotation motor 17, and the like. The controller 9 is also connected to an operation panel 34, a PC 35 as an external device, etc.

The controller 9 (a controller of the present teaching) controls the CPU 30 and the ASIC 33 to carry out various processes according to programs stored in the ROM 31. To give an example, based on a print command sent from the PC 35, the controller 9 controls the ink-jet head 3 and the transport motor 12 to print images and the like on the recording paper 100. Further, the controller 9 controls the purge pump 6 and the wiping unit 8 to perform maintenance for the elimination or prevention of the jetting failure of the ink-jet head 3. In particular, the controller 9 controls the purge pump 6 to perform the purge of the ink-jet head 3. Further, the controller 9 controls the wiping drive motor 19 and the rotation motor 17 so that the wiping device 13 wipes the ink jetting surface 3*a* of the ink-jet head 3 to remove foreign substances and ink adhering to the ink jetting surface 3*a*. Although illustrations are omitted, the controller 9 also controls the operation of an activating section, such as a motor, included in each of the opening-closing mechanism rotating or pivoting the two plate members 2*a* and 2*b* (see FIG. 1) of the platen 2, the head lifting mechanism moving the ink-jet head 3 upward/downward, and the ink-receiving lifting mechanism moving the ink receiving member 7 upward/downward.

Although the controller 9 controls the CPU 30 and the ASIC 33 to carry out various processes in the above example, the present teaching is not limited to this. The controller 9 may he achieved by any hardware construction. For example, the processes may be performed by only the CPU or only the ASIC. Further, the functions may be shared and achieved by two or more CPUs and/or two or more ASICs.

Next, an explanation will be made about a maintenance process of the ink-jet head 3 executed by the controller 9 while referring to FIG. 6.

The maintenance process is consistently carried out while the printer I is powered on, and the controller 9 stands by in a state of waiting for a maintenance command to be inputted (S10). When there is any indistinctness in an image printed on the recording paper 100, etc., if a user manipulates the operation panel 34 to input the maintenance command for eliminating the jetting failure to the controller 9 (S10: Yes), the controller 9 judges that the jetting failure has occurred in the nozzles 10 and the controller 9 performs a purge process first (S11).

Figure 6:
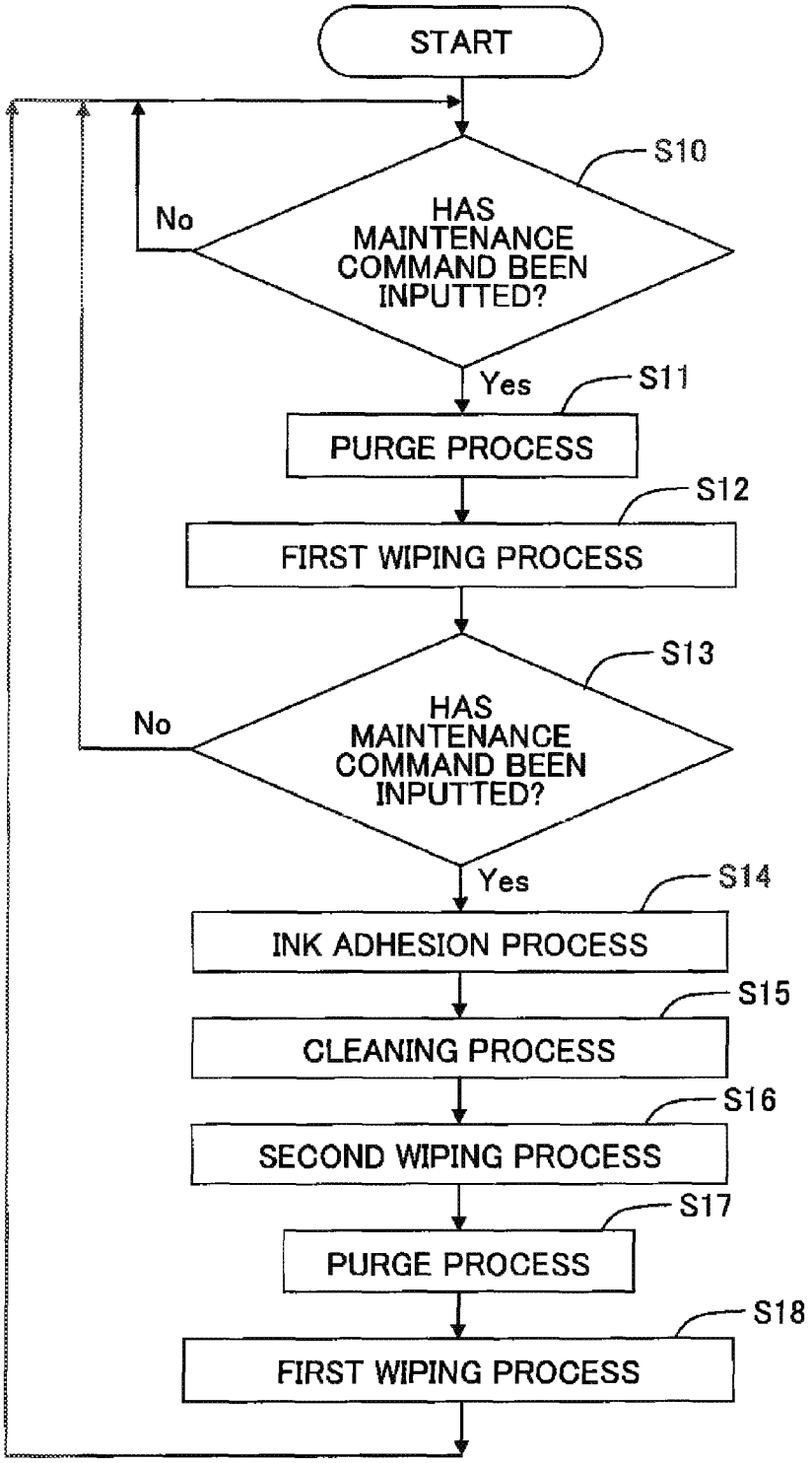
FIG. 6 is a flowchart of a maintenance process.

Although FIG. 6 illustrates the purge process executed when the maintenance command has been inputted by the user, it may be a purge process executed at timing other than. the above. For example, it may be a scheduled purge to be carried out automatically whenever a certain period of time passes. That is, in a case that a predetermined period has elapsed after execution of the last purge process, the controller 9 judges that the jetting failure might occur in the nozzles 10 and then the controller 9 performs the purge process.

[Purge Process]

Before the purge process, the controller 9 operates the unillustrated opening-closing mechanism of the platen 2, the head lifting mechanism, and the ink-receiving lifting mechanism to position the ink-receiving member 7 immediately below the ink jetting surface 3*a* of the ink-jet head 3, as shown in FIG. 4. The controller 9 controls the purge pump 6 in this state so that ink from the unillustrated ink tank is pressurized to be supplied to the ink-jet head 3, Accordingly, the ink is forcibly discharged from the nozzles 10 of the ink-jet head 3. In this situation, if there are air (bubbles), thickened ink, and the like, those of which might cause the jetting failure, in ink channels in the ink-jet head 3, the air and the like are discharged with the ink from the nozzles 10.

[First Wiping Process: Wiping of Ink]

Through the above purge, a part of the ink discharged from the nozzles 10 adheres to the ink jetting surface 3*a*. Thus, the controller 9 controls the wiping unit 8 to perform a first wiping process in which the ink adhering to the ink jetting surface 3*a* is wiped by the first wiping portion 15*a* of the wiper 15 (S12).

Before the first wiping process, the controller 9 operates the unillustrated ink-receiving lifting mechanism to lower the ink-receiving member 7 down to a position below the wiping unit 8, as shown in FIG. 5. The wiping device 13 stands by at the right side of the ink jet head 3. In this situation, the wiper 15 is in the first posture depicted by the solid line in FIG. 5, and the front end portion of the wiper 15 is positioned above a horizontal surface including the ink jetting surface 3*a* of the ink jet head 3. The controller 9 controls the wiping drive motor 19 in this state to move the wiping device 13 leftward. Then, the front end portion of the wiper 15 is flexed or bent by being pressed against the ink jetting surface 3*a*, so that the first wiping portion 15*a* positioned at the left side portion of the front end portion comes into contact with the ink jetting surface 3*a*. By moving the wiper 15 leftward in this state, the first wiping portion 15*a* wipes away the ink adhering to the ink jetting surface 3*a*.

When the jetting failure of the nozzles 10 is caused by some air mixed into, and/or some thickened ink dried in, the ink channels inside the ink-jet head 3, it is possible to eliminate the jetting failure through the purge by discharging the air and/or the thickened ink with the ink discharged from the nozzles 10. However, when foreign substances such as paper dust are stuck in the nozzles 10, it may also cause the jetting failure. Paper dust or paper powder is long paper fiber, and may sometimes enter deeply into the nozzles 10, In such cases, it is not easy to discharge the foreign substances such as the paper dust through the purge, and it is also possible that the jetting failure is not eliminated even though the purge is carried out many times. Then, the user can perform test printing after the first wiping process to confirm whether or not the jetting failure is eliminated. In a case that the jetting failure is not eliminated, the user can input the maintenance command again. In a case that the maintenance command has been inputted, the controller 9 judges that the jetting failure has occurred in the nozzles 10.

In a case that the maintenance command is inputted again after the purge process in S11 is performed and before a predetermined time elapses (S13: Yes) for reasons that the jetting failure is not eliminated, etc., the controller 9 performs a second wiping process so that the ink jetting surface 3*a* is wiped by the second wiping portion 15*b* for eliminating the foreign substances, of the wiper 15 (S16).

However, if the second wiping portion 15*b* wipes the ink jetting surface 3*a* with holding the foreign substances and the like wiped at the previous wiping operation(s) thereon, there is fear that the foreign substances might scrape the ink jetting surface 3*a* to damage the ink jetting surface 3*a*. Further, the foreign substances might adhere to the ink jetting surface 3*a* again. Therefore, in order to remove the foreign substances adhering to the second wiping portion 15*b*, the controller 9 performs an ink adhesion process (S14) and a cleaning process (S15) as will be described below before the second wiping process (S16).

[Ink Adhesion Process]

Figure 7:
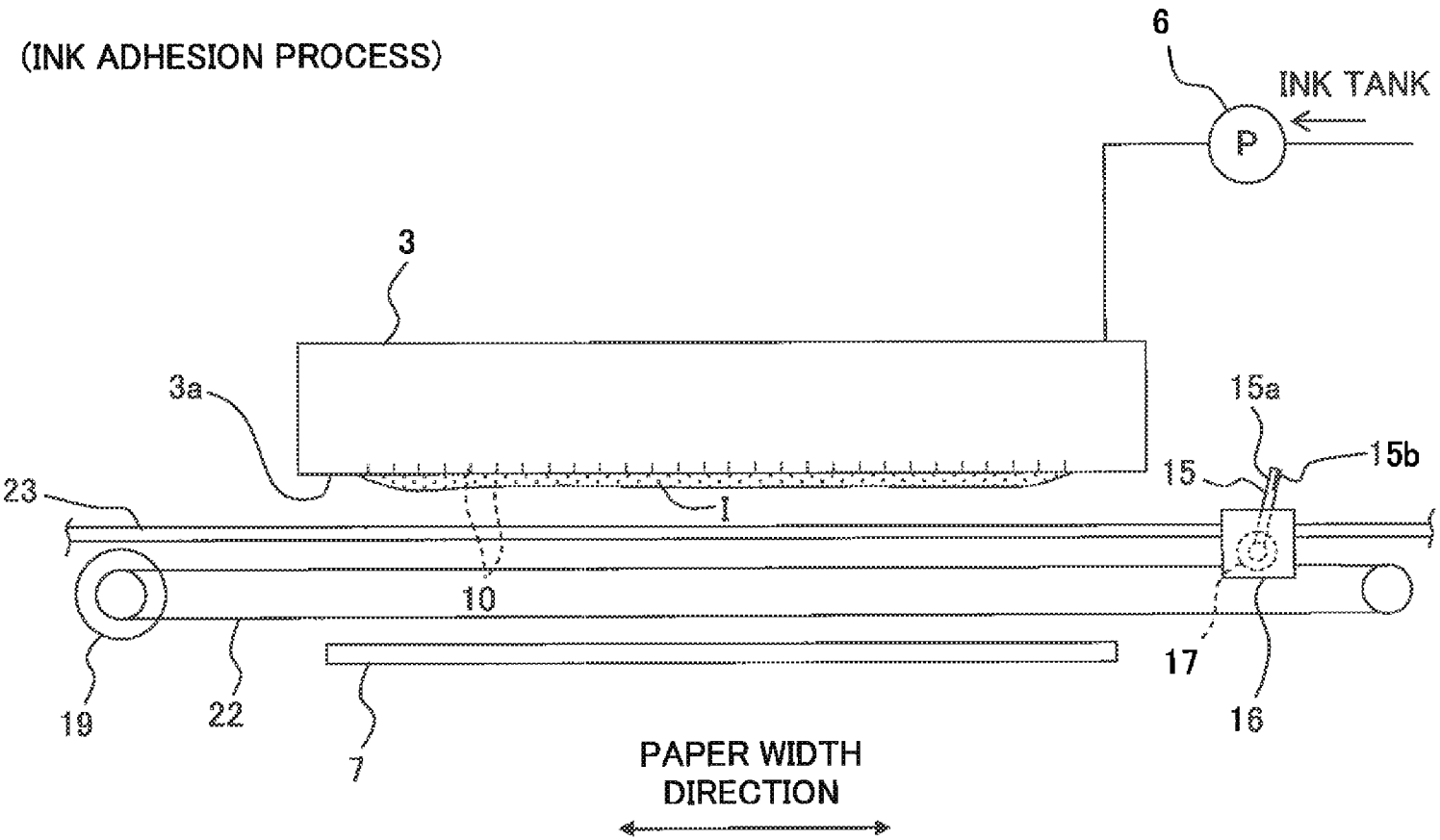
FIG. 7 is a view illustrating an ink adhesion process.

Similar to the above purge process, the purge pump 6 is controlled by the controller 9 to forcibly discharge the ink from the nozzles 10 by pressurizing the ink from the ink tank and supplying the ink to the ink-jet head 3. In this situation, as shown in FIG. 7, a part of the discharged ink spreads over and adheres to the ink jetting surface 3*a*. Here, the ink may be discharged so that the part of the discharged ink spreads over the ink jetting surface 3*a* to cover the entire ink jetting surface 3*a*.

In the purge process for eliminating or preventing the jetting failure of the nozzles 10, it is preferred that an ink discharge amount per unit time (flow rate of discharge of ink) from each of the nozzles 10 be increased to enhance the discharge effect of bubbles and the like in the ink channels. However, if the ink discharge amount per unit time from each of the nozzles 10 is increased in the ink adhesion process similar to the purge process, a flow velocity of discharge of the ink discharged from each of the nozzles 10 is increased, which causes most of the ink discharged from each of the nozzles 10 to fall without adhering to the ink jetting surface 3*a*. Therefore, from the viewpoint of allowing most of the ink to adhere to the ink jetting surface 3*a*, it is preferred that the ink discharge amount per unit time from the inkjet head 3 in the ink adhesion process be smaller than the ink discharge amount in the purge process. In particular, the number of rotation of the purge pump 6 pressurizing the ink may be reduced. By making the ink discharge amount per unit time smaller as described above, it is possible to discharge the ink so that the discharged ink spreads over the ink jetting surface 3*a* to cover the entire ink jetting surface 3*a*.

[Cleaning Process]

At first, the controller 9 controls the rotation motor 17 to change the posture of the wiper 15 waiting at the right side of the inkjet head 3 from the first posture to the second posture, Accordingly, the first wiping portion 15*a* and the second wiping portion 15*b* as the front end portion of the wiper 15 are positioned under the horizontal surface including the ink jetting surface 3*a*. In the second posture, the second wiping portion 15*b* is directed upward, that is, toward the ink jetting surface 3*a*.

Figure 8:
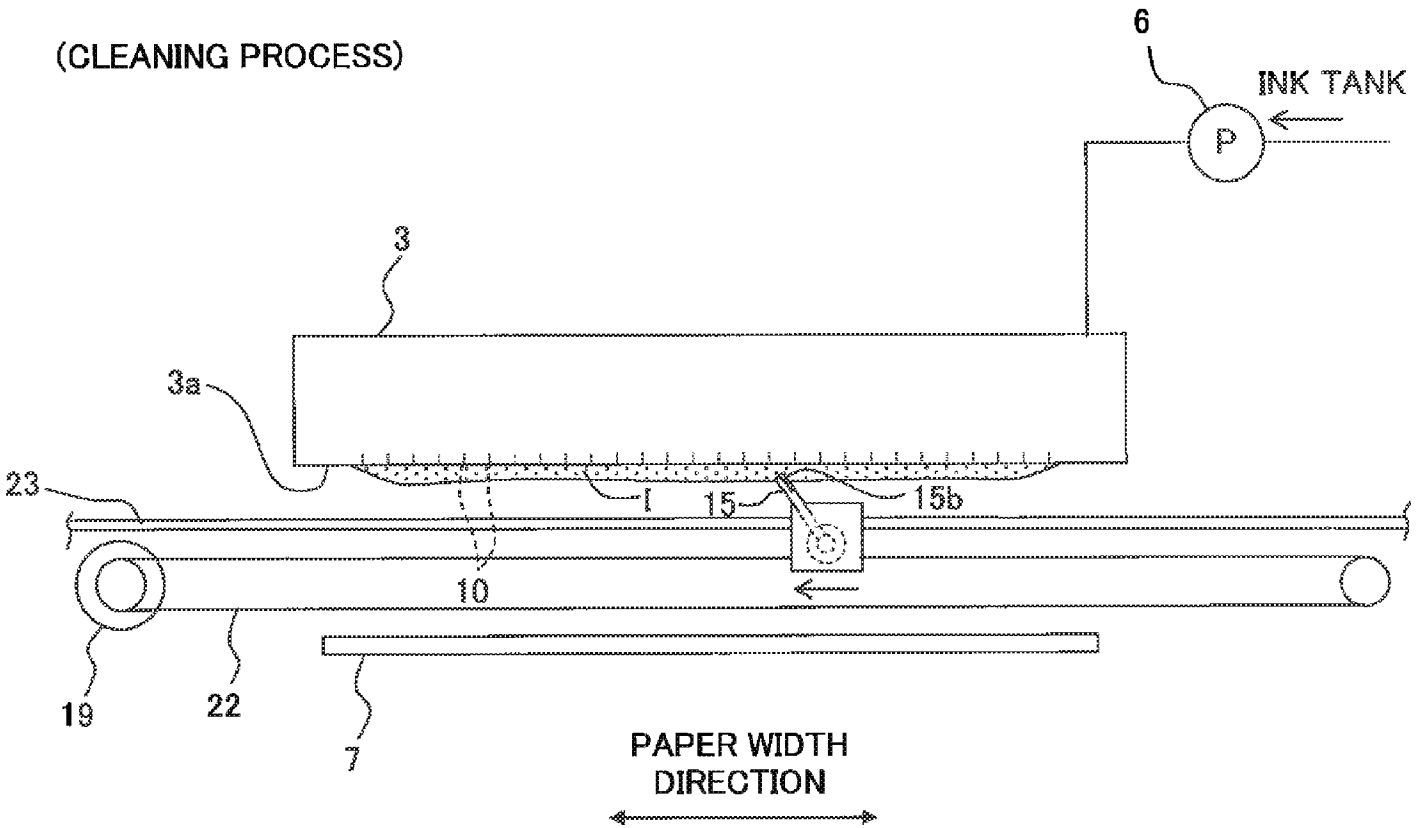
FIG. 8 is a view illustrating a cleaning process.

Subsequently, the controller 9 controls the wiping drive motor 19 to move the wiping device 13 leftward. in this situation, as shown in FIG. 8, the ink adhering to the ink jetting surface 3*a* comes into contact with the front end portion of the wiper 15, especially, the second wiping portion 15*h*. Since the second wiping portion 15*b* is directed toward the ink jetting surface 3*a*, the ink adhering to the ink jetting surface 3*a* reliably comes into contact with the second wiping portion 15*b*, By letting this ink flow over especially the surface of the second wiping portion 15*b*, even when the foreign substances are adherent to the second wiping portion 15*b*, the foreign substances are made to flow downward together with the ink. Since the posture of the wiper 15 is in the second posture, the second wiping portion 15*b* as the front end portion of the wiper 15 is not brought into contact with the ink jetting surface 3*a*. Therefore, in the ink adhesion process, it is preferred that a relatively large amount of ink be made to adhere to the ink jetting surface 3*a* so that the front end portion of the second wiping portion 15*b* comes into contact with the ink adhering to the ink jetting surface 3*a* even when the wiper 15 is in the second posture.

[Second Wiping Process: Removal of Foreign Substances]

After the wiper 15 has been cleaned in the cleaning process, the second wiping process is carried out (S16). The controller 9 controls the rotation motor 17 to change the posture of the wiper 15 from the second posture to the first posture in a state, as shown in FIG. 5, in which the wiping device 13 is located at the left side of the ink-jet head 3. Men, the controller 9 controls the wiping drive motor 19 to move the wiping device 13 rightward. In this situation, as shown in FIG. 5, the front end portion of the wiper 15 is flexed or bent by being pressed against the ink jetting surface 3*a*, so that the second wiping portion 15*b* as the right side portion of the front end portion comes into contact with the ink jetting surface 3*a*. By moving the wiper 15 rightward in this state, the foreign substances adhering to the ink jetting surface 3*a* are wiped away and removed by the second wiping portion I Sb. Since the surface roughness of the second wiping portion 15*b* is greater than that of the first wiping portion 15*a*, the foreign substances, such as paper dust, adhering to the ink jetting surface 3*a* are reliably removed by the second wiping portion 15*b* in a scrape-off manner. In the second wiping process, the ink which has adhered to the ink jetting surface 3*a* in the ink adhesion process, is Wiped by the second wiping portion 15*b* together with the foreign substances.

As shown in FIG. 6, after completion of the second wiping process, the purge process is performed again to form meniscuses in the nozzles 10 (S17). Further, the first wiping process is performed to wipe away the ink adhering to the ink jetting surface 3*a* through the purge of S17 (S18).

As described above, in this embodiment, the second wiping portion 15*b* for removing the foreign substances is cleaned before the second wiping portion 15*b* wipes the ink jetting surface 3*a*. Therefore, a subsequent wiping can be carried out by the second wiping portion 15*b* from which the foreign substances have been eliminated. Since no foreign substances remain in the second wiping portion 15*b*, the ink jetting surface 3*a* suffers no damage due to the foreign substances, and no foreign substances adhere to the ink jetting surface 3*a* again. Further, the ink is allowed to adhere to the ink jetting surface 3*a* by being discharged from the nozzles 10 by the purge pump 6, and then this ink is brought into contact with the wiper 15. Accordingly, the ink adhering to the ink jetting surface 3*a* is made to flow over the second wiping portion 15*h* so as to clean the second wiping portion 15*b*. Since the wiper 15 is cleaned by using the ink discharged from the nozzles 10, any special. cleaning liquid and/or cleaning device is/are unnecessary.

If the second wiping portion 15*b* is brought into contact with the ink jetting surface 3*a* in the cleaning process of FIG. 8, it is difficult to wash, with the ink, the foreign substances adhering to the contact area between the second wiping portion 15*b* and the ink, jetting surface 3*a* and the periphery of the contact area. In FIG. 8, however, since the wiper 15 is in the second posture, the second wiping portion 15*b* is not brought into contact with the ink jetting surface 3*a* in the cleaning process. Accordingly, it is easy to wash, with the ink, the foreign substances adhering to the second wiping portion 15*b*.

Next, an explanation will be given about modified embodiment(s) applying various changes to the above embodiment. Noted that, the same reference numerals are assigned to the members having identical or similar configurations to those of the above embodiment, any explanation of which will be omitted as appropriate.

In the above embodiment, as shown in FIG. 6, the second wiping process is carried out after the wiper 15 is cleaned in the ink adhesion process and the cleaning process. However, the ink adhesion process and the cleaning process may be performed after execution of the second wiping process so that the second wiping section 15*b* is cleaned after the foreign substances have been wiped from the ink jetting surface 3*a*. In such a case, if the second wiping portion 15*b* having the foreign substances adhering thereto is left after the foreign substances have been wiped by the second wiping portion 15*b*, it is conceivable that the foreign substances might get stuck to the second wiping portion 15*b* and it causes difficulty in removing the foreign substances. Thus, it is preferred that the ink adhesion process and the cleaning process be performed immediately after the second wiping process. The cleaning process may be performed before and after the second wiping process.

Other one or more process(es) may be performed between the ink adhesion process and cleaning process, and the second wiping process. For example, the first wiping process for wiping out the ink using the first wiping portion 15*a* may be carried out after completion of the cleaning process, and then the second wiping process may be performed.

Figure 9:
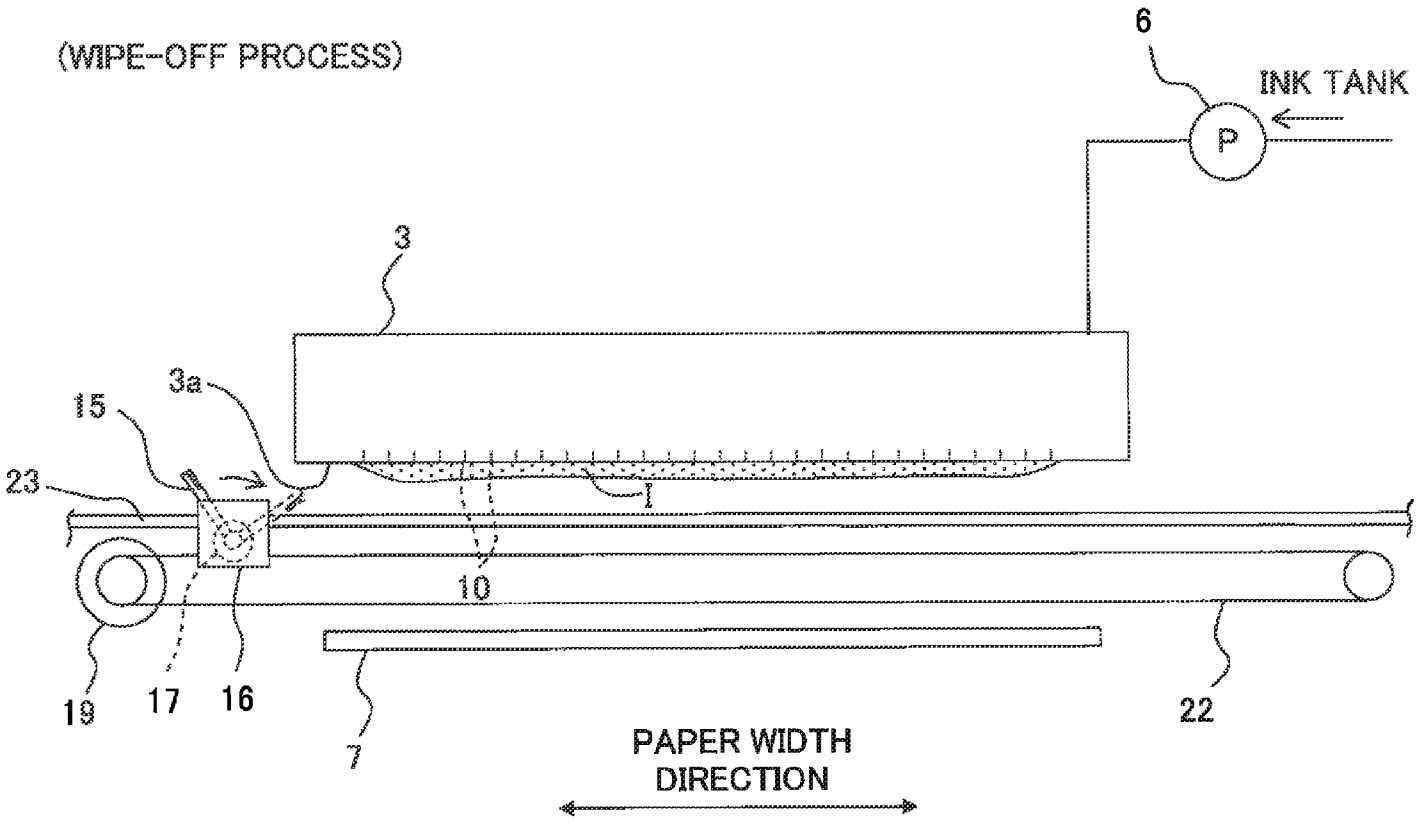
FIG. 9 is a view illustrating a wipe-off process according to a modified embodiment.

In the above embodiment, the positions of the first and second wiping portions 15*a*, 15*b* can be changed by rotating the wiper 15. By utilizing this configuration, the following wipe-off process may be performed. That is, the controller 9 controls the rotation motor 17 to rotate the wiper 15 after execution of the cleaning process as shown in FIG. 9, so that the ink adhering to the wiper 15 is wiped off. This wipe-off process can wipe off the foreign substances which have not been removed in the cleaning process, together with the ink, and can reliably remove the foreign substances adhering to the second wiping portion 15*b*. The foreign substances adhering to the wiper 15 become more likely to be wiped off, as a rotation speed of the wiper 15 is greater. Therefore, the rotation speed of the wiper 15 in the wipe-off process may be greater than a rotation speed of the wiper 15 at the time of changing the positions of the first and second wiping portions 15*a*, 15*b*. The wiper 15 may be rotated repeatedly.

In the above embodiment, in a case that the wiper 15 with a dry surface is brought into contact with the ink in the cleaning process of FIG. 8, it is conceivable that the ink might flow only along a specific path on the surface of the wiper 15. In this situation, there is fear that the ink might not spread over the entire surface of the wiper 15 and thereby the foreign substances adhering to the second wiping portion 15*b* is not allowed to flow with the ink.

Figure 10:
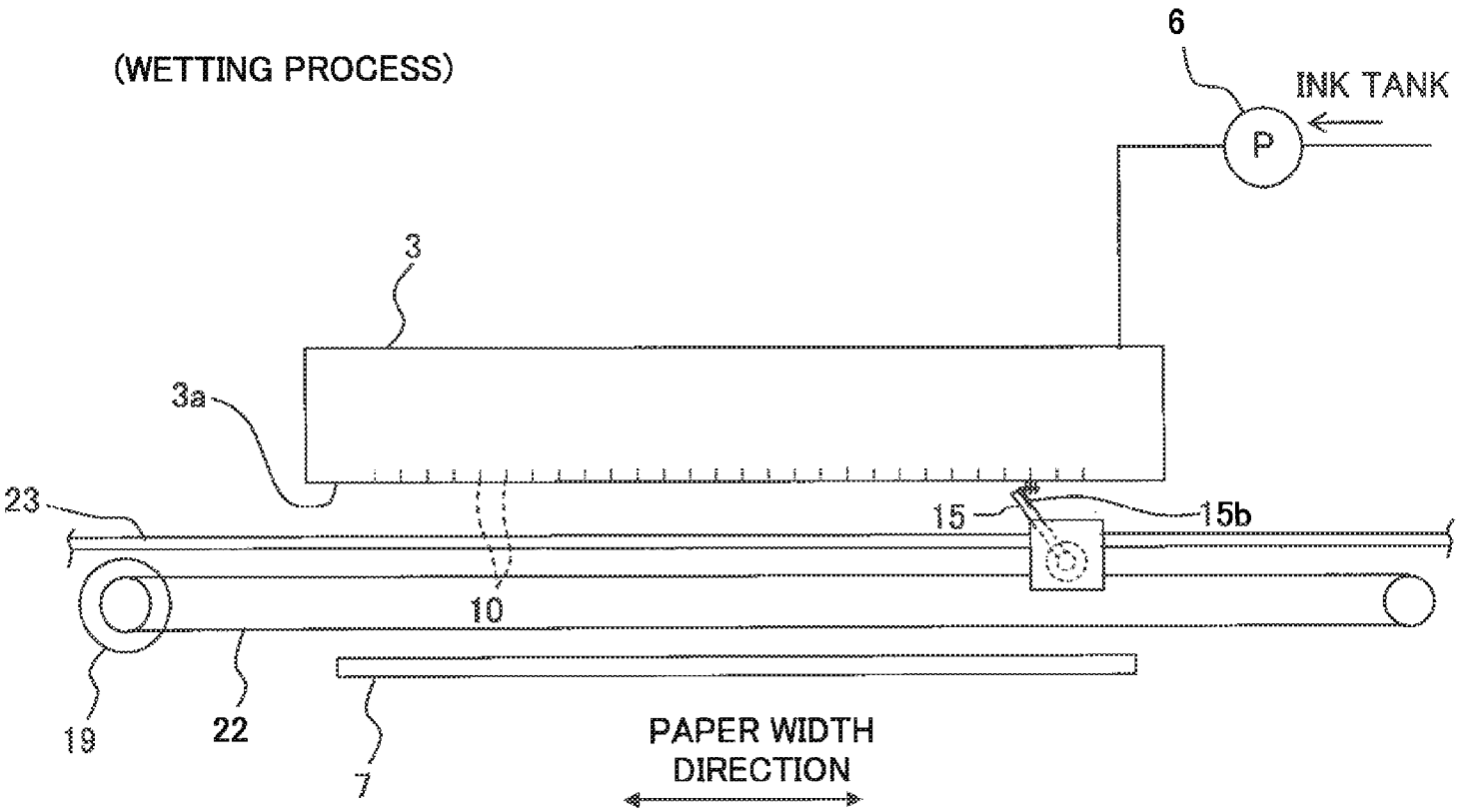
FIG. 10 is a. view illustrating a wetting process according to another modified embodiment.

In view of the above, a wetting process may be performed before the cleaning process, the wetting process being a process in which the ink is discharged from the nozzles 10 to the wiper 15 by the controller 9 so as to wet the second wiping portion 15*b* with the ink. As shown in FIG. 10, the controller 9 controls the wiping drive motor 19 to move the wiper 15 to a position immediately below one nozzle 10. Subsequently, the controller 9 controls the ink-jet head 3 to jet the ink from the one nozzle 10 immediately above the wiper 15 to the second wiping portion 15*b*. Since the ink jetted from the one nozzle 10 is scattered upon colliding with the second wiping portion 15*b* and the ink is blown to the second wiping portion 15*b* like spray, it is possible to wet the second wiping portion 15*b* entirely, As described above, by wetting the second wiping portion 15*b* of the wiper 15 with the ink before the cleaning of the wiper 15, the ink flowing from the ink jetting surface 3*a* becomes more likely to spread over the entire second wiping portion 15*b* at the time of performing the cleaning process. Although the wiper 15 is stopped at the position immediately below the specific nozzle 10 in FIG. 10, the ink may be jetted from each of the nozzles 10 sequentially, while the wiper 15 is moved in the paper width direction, at a timing at which the wiper 15 has arrived at a position immediately below each of the nozzles 10.

Although FIG. 10 shows the example in which the wetting process is performed before the ink adhesion process, the wetting process may be performed after execution of the ink adhesion process shown in FIG. 7. If the ink adheres to the substantially entire ink jetting surface 3*a* in the ink adhesion process as shown in FIG. 7, it is difficult to jet the ink normally from the nozzles 10 in the wetting process performed after the ink adhesion process. In this case, an ink discharge amount (flow rate of discharge of ink) may be increased by controlling the purge pump 6 so as to reduce an amount of ink adhering to the ink jetting surface 3*a*.

In the above embodiment, the wiper 15 is rotated by the rotation motor 17 to change the positions of the first and second wiping portions 15*a*, 15*b* in the up-down direction. However, it may be configured such that the wiper 15 is moved up and down by an actuator such as a motor and a cylinder. Alternatively, it may be configured such that the ink-jet head 3 is moved up and down by the actuator such as the motor and the cylinder, instead of or in addition to the configuration for moving the wiper 15 up and down.

Figure 11:
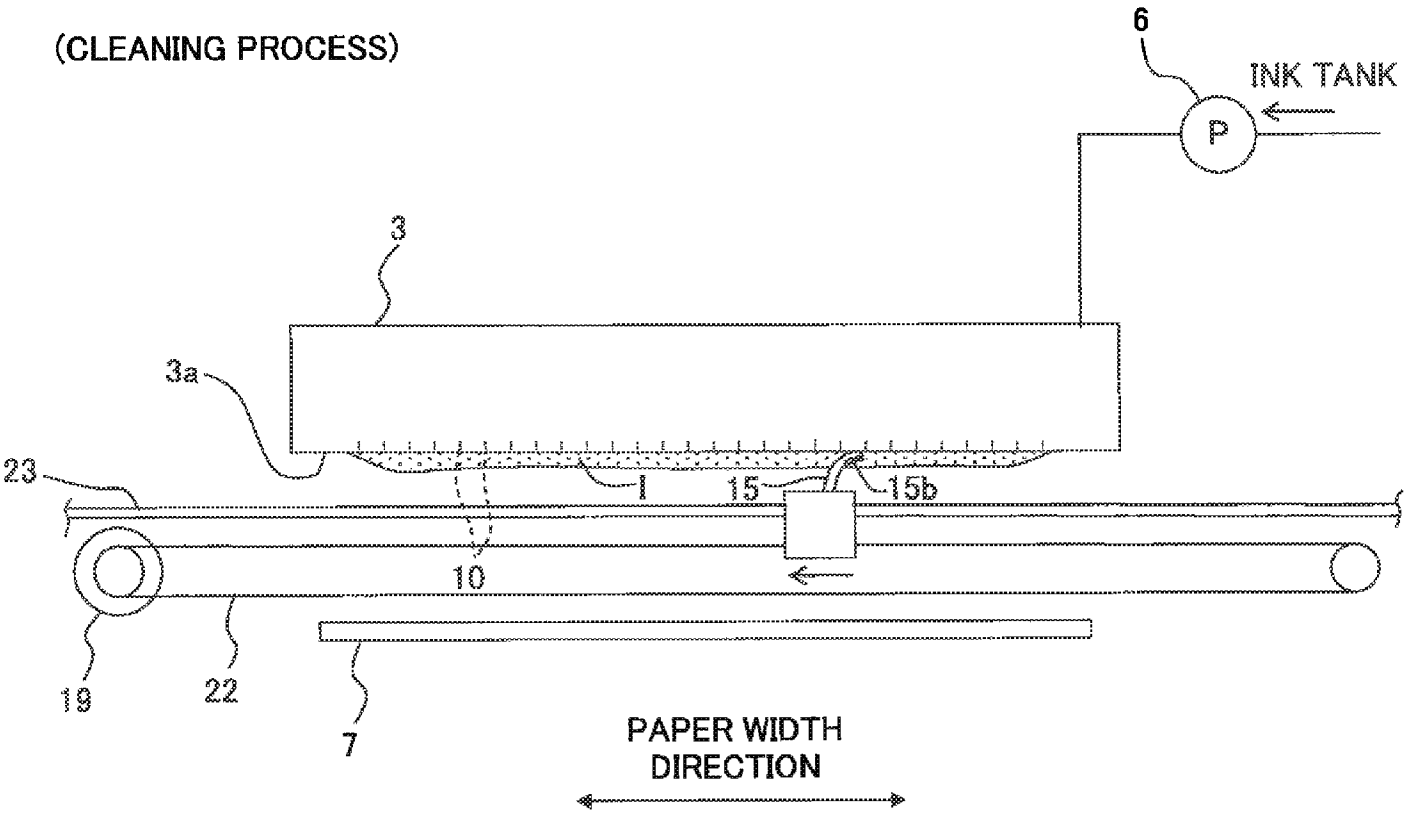
FIG. 11 is a view illustrating a cleaning process according to still another modified embodiment.

Further, it is possible to adopt such a configuration that the positions of the first and second wiping portions 15*a*, 15*b* in the up-down direction are not changed in the first wiping process, the second wiping process, and the cleaning process, respectively. In this case, although it is conceivable that the second wiping portion 15*b* might come into contact with the ink jetting surface 3*a* at the time of the cleaning, even if the second. wiping portion 15*b* is brought into contact with the ink jetting surface 3*a*, it is possible to flush or rinse the foreign substances adhering to the second wiping portion 15*b* with the ink, Further, as shown in FIG. 11, in a case that the wiping device 13 is moved leftward at the time of the cleaning so that the first wiping portion 15*a* comes into contact with the ink jetting surface 3*a*, it is possible to avoid that the second wiping portion 15*b* comes into contact with the ink jetting surface 3*a*.

In the ink adhesion process of the above embodiment, the ink is discharged to be pushed out of the nozzles 10 (so-called pressurized purge) by pressurizing the ink by the purge pump 6 from the upstream side of the ink-jet head 3. The present teaching, however, can adopt a so-called suction purge in which a cap member is installed in the ink-jet head 3 to cover the nozzles 10 and the ink is sucked and discharged from the nozzles 10 by reducing the pressure in the cap member by use of a suction pump connected to the cap member.

Figure 12:
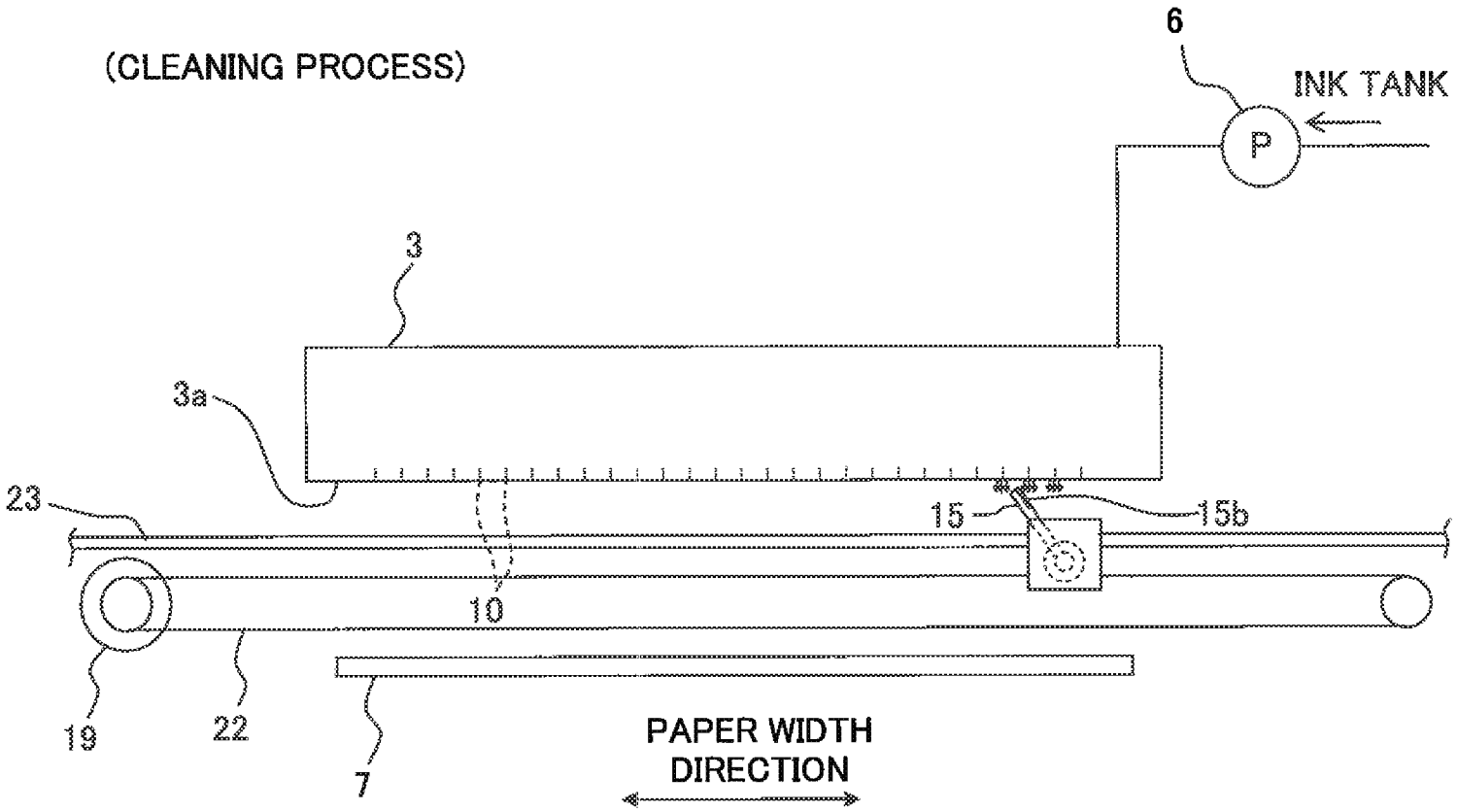
FIG. 12 is a view illustrating a cleaning process according to yet another modified embodiment.

In the above embodiment, the wiper 15 is cleaned as follows. That is, the ink is forcibly discharged from the nozzles 10 to adhere to the ink jetting surface 3*a* and then the wiper 15 is brought into contact with this discharged ink. The wiper 15, however, may be cleaned by jetting the ink from the nozzles 10 directly to the wiper 15. This cleaning process is substantially similar to the wetting process as shown in FIG. 10. That is, as shown in FIG. 12, the controller 9 first controls the wiping drive motor 19 to move the wiper 15 immediately below one nozzle 10. Next, the controller 9 controls the ink-jet head 3 to jet the ink from the one nozzle 10 immediately above the wiper 15 to the second wiping portion 15*b* of the wiping portion 15. Similar to the wetting process, also in FIG. 12, the ink may be jetted from each of the nozzles 10 sequentially, while the wiper 15 is moved in the paper width direction, at a timing at which the wiper 15 has arrived at a position immediately below each of the nozzles 10. In this situation, the ink may be jetted from each of the nozzles 10 to the wiper 15 in a state that the wiper 15 is not brought into contact with the ink jetting surface 3*a*.

In the embodiment shown in FIG. 12, since the second wiping portion 15*b* is cleaned by the ink jetted from the nozzles 10 of the inkjet head 3 to the wiper 15, any special cleaning liquid and/or cleaning device is/are unnecessary, similar to the above embodiment. Further, it is possible to blow away the foreign substances adhering to the second wiping portion 15*b* by energy of the ink jetted from the nozzles 10, in addition to the function of rinsing the foreign substances with the ink adhering to the wiper 15. Therefore, the cleaning effect is great. It is preferred that the ink jetted from the nozzles 10 of the ink-jet head 3 be less likely to solidify. For example, in a case that pigment ink and dye ink are jetted from the nozzles 10 of the ink-jet head 3, it is preferred that the cleaning process be performed by using the dye ink.

An object of the cleaning process in FIG. 12 is to eliminate the foreign substances adhering to the second wiping portion 15*b*. The effect of eliminating the foreign substances is higher, as the jetting energy of the ink jetted from the nozzles 10 is greater. Therefore, in a case that the size and/or jetting speed of liquid droplets jetted from the nozzles 10 can be changed, it is preferred that the cleaning process be performed in such a setting that the size of liquid droplets is largest and the jetting speed of liquid droplets is fastest. Further, in FIG. 12, since the second wiping portion 15*b* is cleaned by the in jetted from the nozzles 10, the ink adhesion process (FIG. 7) in the above, embodiment is not required. Therefore, the embodiment shown in FIG. 12 can also be applied to a printer having no construction in which the ink is forcibly discharged from the nozzles 10 such as the purge pump 6.

Although the above embodiment has exemplified the configuration that the wiping device 13 is moved relative to the ink-jet head 3 to wipe the ink jetting surface 3*a*, it may be configured such that the ink-jet head 3 is moved relative to the wiping device 13. Further, it may be configured such that both of the ink jet-head 3 and the wiping device 13 are moved.

For example, in a case that the ink-jet head is a so-called serial head which is mounted on a carriage moving in a paper width direction and jets ink while moving in the paper width direction, an ink jetting surface can he wiped by the wiping device 13 by moving the ink-jet head relative to the wiping device 13 provided fixedly on the printer 1.

There are certain types of foreign substances which are more likely to emerge with a longer duration of using the printer 1. For example, while paper dust is scattered from the recording paper 100 being transported, for the reason that the surfaces of the transport rollers 4 and 5 become roughened due to aged deterioration, etc., it is conceivable that the amount of emergence of paper dust increases as the printer 1 is used for a longer time. Further, if the second wiping process, in which the ink jetting surface 3*a* is wiped by the second wiping portion 15*b* having great surface roughness, is carried out too often, the ink jetting surface 3*a* is liable to he roughened. If the ink jetting surface 3*a* is roughened, the ink repellency of the ink jetting surface 3*a* becomes low. Thereby, the ink jetting surface 3*a* becomes more likely to be soaked. with the ink, and thus it becomes difficult to remove the ink adhering to the ink jetting surface 3*a* through the first wiping process. Hence, in the initial state of using the printer 1 where the foreign substances such as paper dust are less likely to adhere, it is preferable not to carry out the unnecessary second wiping process.

Therefore, the controller 9 may decide whether or not to perform the second wiping process according to how long the printer 1 is used. For example, the controller 9 may first count the total number of printed sheets of the recording paper 100 so far, and then causes the wiping device 13 to perform the second wiping process if the total number of printed sheets exceeds a predetermined number of sheets.

In the above embodiment, the positions of the first and second wiping portion 15*a*, 15*b* can be changed by rotating the wiper 15 by the rotation motor 17. In this context, the controller 9 may adjust the angle between the wiper 15 and the ink jetting surface 3*a* such that said angle formed when the first wiping portion 15*a* is brought into contact with the ink jetting surface 3*a* is different from said angle formed when the second wiping portion 15*b* is brought into contact with the ink jetting surface 3*a*. For example, in the first wiping process, the angle between the wiper 15 and the ink jetting surface 3*a* may be approximately 60 degrees so as to make the first wiping portion 15*a* contact with the ink jetting surface 3*a*. In the second wiping process, the angle between the wiper 15 and the ink jetting surface 3*a* may be approximately 90 degrees so as to make the second wiping portion 15*h* contact with the ink jetting surface 3*a*. As described above, in the second wiping process, the angle between the wiper 15 and the ink jetting surface 3*a* can be set to be closer to 90 degrees as compared with the angle formed in the first wiping process. In such a case, the force exerted on the ink jetting surface 3*a* upon the contact between the ink wiper 15 and the ink jetting surface 3*a* in the second wiping process is allowed to be greater than that in the first wiping process. Therefore, for example, even when the first wiping portion 15*a* and the second wiping portion 15*b* have the same surface roughness, the foreign substances adhering to the ink jetting surface 3*a* can be scraped off with a stronger force in the second wiping process as compared with the first wiping process.

In the above embodiment and its modifications explained above, the present invention is applied to an inkjet printer which jets ink onto a sheet of recording paper to print an image and the like. However, it is also possible to apply the present invention to any liquid jetting apparatuses used for various purposes other than the printing of the image and the like. For example, it is also possible to apply the present invention to a liquid jetting apparatus which jets an electrically conductive liquid to a substrate to form a conductive pattern on a surface of the substrate.

What is claimed is:

1. A liquid jetting apparatus configured to jet liquid, comprising:

a liquid jetting head including a liquid jetting surface in which a plurality of nozzles are formed;

a wiper configured to wipe the liquid jetting surface of the liquid jetting head;

a moving mechanism configured to move at least one of the wiper and the liquid jetting head such that the wiper is moved relative to the liquid jetting head in a first direction parallel to the liquid jetting surface;

a liquid discharge mechanism configured to discharge the liquid from the nozzles of the liquid jetting head;

a position change mechanism configured to change position of the wiper in a direction perpendicular to the liquid jetting surface by rotating the wiper around a rotational shaft parallel to the liquid jetting surface and perpendicular to the first direction;

a liquid receiving member arranged to face the liquid jetting surface to receive the liquid; and a controller configured to control the liquid jetting head, the moving mechanism, the position change mechanism, and the liquid discharge mechanism, the controller being configured to perform:

controlling the liquid jetting head to jet the liquid from the nozzles such that the liquid adheres onto the liquid jetting surface;

controlling the moving mechanism to move the wiper relative to the liquid jetting head in a direction parallel to the liquid jetting surface in a state in which a first surface of the wiper is away from the liquid jetting surface, such that the first surface of the wiper makes a contact with the liquid adhered onto the liquid jetting surface and that the adhered liquid flows from the liquid jetting surface to the first surface of the wiper;

thereafter, controlling the moving mechanism to move the wiper to a position at which the wiper is not overlapped with the liquid jetting head as viewed in a direction perpendicular to the liquid jetting surface and at which the first surface of the wiper is located closer to the liquid receiving member in the first direction as compared with a second surface of the wiper that is opposite to the first surface; and controlling the position changing mechanism to rotate the wiper toward the liquid receiving member multiple times at the said position wherein the controller is configured to control the position change mechanism such that the wiper rotated to wipe off the liquid adhering to the wiper.

2. A liquid jetting apperatus configured to jet liquid, comprising:

a liquid jetting head including a liquid jetting surface in which a plurality of nozzles are formed:

a wiper configured to wipe the liquid jetting surface of the liquid jetting head;

a moving mechanism configured to move at least one of the wiper and the liquid jetting head such that the wiper is moved relative to the liquid jetting head in a first direction parallel to the liquid jetting surface;

a liquid discharge mechanism configured to discharge the liquid from the nozzles of the liquid jetting head;

a position change mechanism configured to change position of the wiper in a direction perpendicular to the liquid jetting surface by rotating the wiper around a rotational shaft parallel to the liquid jetting surface and perpendicular to the first direction;

a liquid receiving member arranged to face the liquid jetting surface to receive the liquid; and a controller configured to control the liquid jetting head, the moving mechanism, the position change mechanism, and the liquid discharge mechanism, the controller being configured to perform;

controlling the liquid jetting head to jet the liquid from the nozzles such that the liquid adheres onto the liquid jetting surface;

controlling the moving mechanism to move the wiper relative to the liquid jetting head in a direction parallel to the liquid jetting surface in a state in which a first surface of the wiper is away from the liquid jetting surface, such that the first surface of the wiper makes a contact with the liquid adhered onto the liquid jetting surface and that the adhered liquid flows from the liquid jetting surface to the first surface of the wiper;

thereafter, controlling the moving mechanism to move the wiper to a position at which the wiper is not overlapped with the liquid jetting head as viewed in a direction perpendicular to the liquid jetting surface and at which the first surface of the wiper is located closer to the liquid receiving member in the first direction as compared with a second surface of the wiper that is opposite to the first surface; and controlling the position changing mechanism to rotate the wiper toward the liquid receiving member multiple times at the said position, wherein the wiper includes a first wiping portion which is configured to wipe away liquid adhering to the liquid jetting surface and a second wiping portion which is configured to eliminate a foreign substance adhering to the liquid jetting surface; and wherein the controller is configured to perform controlling the liquid jetting head to jet the liquid from the nozzles such that the liquid makes a contact with the second wiping portion to clean the second wiping portion, in a state that the second wiping portion is away from the liquid jetting surface of the liquid jetting head.

3. The liquid jetting apparatus according to claim 1, wherein the wiper includes a first wiping portion which is configured to wipe away liquid adhering to the liquid jetting surface and a second wiping portion which is configured to eliminate a foreign substrate adhering to the liquid jetting surface; and wherein the controller is configured to perform:

controlling the liquid discharge mechanism to discharge the liquid from the nozzles to let the liquid adhere to the liquid jetting surface; and controlling the moving mechanism to clean the second wiping portion by making the wiper contact with the liquid adhering to the liquid jetting surface and letting the liquid flow from the liquid jetting surface to the second wiping portion.

4. The liquid jetting apparatus according to claim 3, wherein the controller is configured to control the position change mechanism so as not to make the second wiping portion contact with the liquid jetting surface at the time of the cleaning of the second wiping portion.

5. The liquid jetting apparatus according to claim 3, wherein the controller is configured to control the liquid jetting head and the moving mechanism such that the liquid is jetted from the nozzles of the liquid jetting head to the second wiping portion of the wiper before the cleaning of the second wiping portion to wet the second wiping portion with the liquid.

6. The liquid jetting apparatus according to claim 1, wherein the controller is configured to perform controlling the liquid jetting head and the moving mechanism to jet the liquid from the nozzles to the wiper, and thereby cleaning the second wiping portion.

7. A method for cleaning a wiper of a liquid jetting apparatus, the liquid jetting apparatus comprising:

a liquid jetting head including a liquid jetting surface in which a plurality of nozzles are formed;

the wiper, wherein the wiper includes a first wiping portion which is configured to wipe away liquid adhering to the liquid jetting surface and a second wiping portion which is configured to eliminate a foreign substance adhering to the liquid jetting surface;

a liquid discharge mechanism configured to discharge the liquid from the nozzles of the liquid jetting head;

a position change mechanism configured to change position of the wiper in a direction perpendicular to the liquid jetting surface by rotating the wiper around a rotational shaft parallel to the liquid jetting surface; and a liquid receiving member arranged to face the liquid jetting surface to receive the liquid;

the method comprising:

discharging the liquid from the nozzles by the liquid discharge mechanism to allow the liquid to adhere to the liquid jetting surface;

moving the wiper relative to the liquid jetting head in a first direction parallel to the liquid jetting surface in a state in which a first surface of the wiper is away from the liquid jetting surface, such that the first surface of the wiper makes a contact with the liquid adhered onto the liquid jetting surface and that the adhered liquid flows from the liquid jetting surface to the first surface of the wiper;

moving the wiper such that the liquid makes a contact with the second wiping portion to clean the second wiping portion, in a state that the second wiping portion is away from the liquid jetting surface of the liquid jetting head;

thereafter, moving the wiper to a position at which the wiper is not overlapped with the liquid jetting head as viewed in a direction perpendicular to the liquid jetting surface and at which the first surface of the wiper is located closer to the liquid receiving member in the first direction as compared with a second surface of the wiper that is opposite to the first surface; and rotating the wiper toward the liquid receiving member multiple times at the said position.

8. The liquid jetting apparatus according to claim 1, wherein the wiper includes a first wiping portion which is configured to wipe away liquid adhering to the liquid jetting surface and a second wiping portion which is configured to eliminate a foreign substance adhering to the liquid jetting surface, and wherein a rotation speed of the wiper at the position is greater than a rotation speed of the wiper at a time of changing positions of the first and second wiping portions.

9. The liquid jetting apparatus according to claim 1, wherein the wiper includes a first wiping portion which is configured to wipe away liquid adhering to the liquid jetting surface and a second wiping portion which is configured to eliminate a foreign substance adhering to the liquid jetting surface, wherein the controller is configured to perform:

controlling the moving mechanism to cause the first wiping portion to wipe the liquid jetting surface in a state that the first wiping portion is brought into contact with the liquid jetting surface;

thereafter, controlling the moving mechanism to move the wiper to the position, and controlling the position changing mechanism to rotate the wiper in a plurality of times at the position, thereafter, controlling the liquid jetting head to perform a purge operation, and thereafter, controlling the moving mechanism to cause the first wiping portion to wipe the liquid jetting surface in a state that the first wiping portion is brought into contact with the liquid jetting surface, again.

10. The liquid jetting apparatus according to claim 1, wherein the wiper includes a first wiping portion which is configured to wipe away liquid adhering to the liquid jetting surface and a second wiping portion which is configured to eliminate a foreign substance adhering to the liquid jetting surface, wherein the second wiping portion is located on the first surface of the wiper, and wherein the controller is configured to control the moving mechanism and the position changing mechanism to move the wiper to face with the liquid jetting surface, under a condition that the wiper is moved in the direction parallel to the liquid jetting surface.

11. The liquid jetting apparatus according to claim 1, wherein the wiper includes a first wiping portion which is configured to wipe away liquid adhering to the liquid jetting surface and a second wiping portion which is configured to eliminate a foreign substance adhering to the liquid jetting surface, and wherein a rotation angle of the wiper in the plurality of times at the position is greater than a rotation angle of the wiper at a time of changing positions of the first and second wiping portions.

* * * * *